United States Patent [19]

Spanjer et al.

[11] Patent Number: 5,015,925

[45] Date of Patent: May 14, 1991

[54] PICTURE DISPLAY DEVICE

[75] Inventors: Tjerk G. Spanjer; Gerardus A. H. M. Vrijssen, both of Eindhoven, Netherlands

[73] Assignee: U.S. Philips Corporation, New York, N.Y.

[21] Appl. No.: 461,888

[22] Filed: Jan. 8, 1990

[30] Foreign Application Priority Data

Jan. 12, 1989 [NL] Netherlands ..... 8900069

[51] Int. Cl.[5] ..... G09G 1/04; H01J 29/58; H01J 29/50; H01J 29/46

[52] U.S. Cl. ..... 315/382; 315/370; 313/414; 313/450

[58] Field of Search ..... 315/382, 370; 313/414, 313/450, 476, 437

[56] References Cited

U.S. PATENT DOCUMENTS 3,223,871 12/1965 Schlesinger ..... 315/382
3,979,631 9/1976 van der Ven ..... 313/450

*Primary Examiner*—Gregory C. Issing
*Attorney, Agent, or Firm*—Robert J. Kraus

[57] ABSTRACT

Picture display device comprising a display tube with an electron gun having a tubular structure with an outer surface and an inner surface on which a helical resistance structure is provided in a layer of a material having a high electrical resistance for constituting a focusing lens. In the layer is also formed a coaxial correction element for generating an electric multi-pole field. The outer surface is provided with electrodes of readily electrically conducting material arranged opposite the correction element for capacitively coupling a dynamic correction signal into the correction element.

5 Claims, 3 Drawing Sheets

PICTURE DISPLAY DEVICE

BACKGROUND OF THE INVENTION

The invention relates to a picture display device comprising a display tube having a display screen and an electron gun facing said screen and having a cathode centred along an electronoptical axis and a plurality of electrodes which jointly constitute a beam-shaping part for generating an electron beam, said gun further comprising a tubular structure having an outer surface and an inner surface on which a material having a high electrical resistance is provided, from which a helical resistance structure is formed which constitutes a focusing lens, said tubular structure having a coaxial input portion and a coaxial output portion.

A focusing lens formed from a high-ohmic resistance layer and having a helical structure for obtaining a low spherical aberration for use in display tubes is known.

Correction elements may also be formed in the high-ohmic resistance layer in front of, between or behind the focusing lens, which elements generate electric multipoles (such as 2-poles, 4-poles, 6-poles, 8-poles). However, it appears that problems occur if a dynamic correction signal is to be applied to these correction elements. The very high resistance of the resistance layer (the resistance per square of specific layers may range between $10^6$ and $10^8$ ohm) causes problems when applying dynamic correction signals, particularly if the frequency of the correction signal exceeds 16 kHz. This is a result of the large intrinsic RC time of the layer.

Since the material of the resistance layer has such a high electrical resistance (for example, 10 GQ) the RC time is large (for example, 10 msec). As a result, the effect of a dynamic correction voltage hardly penetrates the resistance structure. One of the objects of the invention is to provide a picture display tube comprising an electron gun with a focusing lens of the above-mentioned type which is suitable for using dynamic corrections.

SUMMARY OF THE INVENTION

This object is solved in that a coaxial correction element is formed from the material having a high electrical resistance at a position between the coaxial input portion and output portion, while said outer surface is provided with electrode means of electrically readily conducting material arranged opposite the correction element, and voltage-supplying means are provided for applying:

a static focusing voltage to the resistance structure, and a dynamically variable voltage to said electrode means.

An essential aspect of the invention is that the dynamically variable voltage is capacitively coupled in with a metal electrode structure at the outer side of the tube which accommodates on its inner side the high-ohmic resistance layer in which the correction element is formed. This electrode structure preferably has a shape which is adapted to the shape of the correction element and it may be provided as a sheet or foil or as a vapour-deposited layer. It appears to be possible to use dynamic correction signals in this way up to frequencies in the MHz range.

Such a correction element may be located in particular, but not exclusively, between the input portion and/or output portion of the tube and the focusing lens.

If according to a preferred embodiment of the invention the correction elements are interconnected via a high ohmic resistor—for example, a meander in the high-ohmic resistance layer—to a connection which conveys the desired DC voltage, they may statically have the correct potential without necessitating the use of separate lead-throughs through the envelope.

BRIEF DESCRIPTION OF THE DRAWING

Some embodiments of the picture display device according to the invention will now be described in greater detail with reference to the accompanying drawings in which.

DESCRIPTION OF THE PREFERRED EMBODIMENTS

Figure 1:
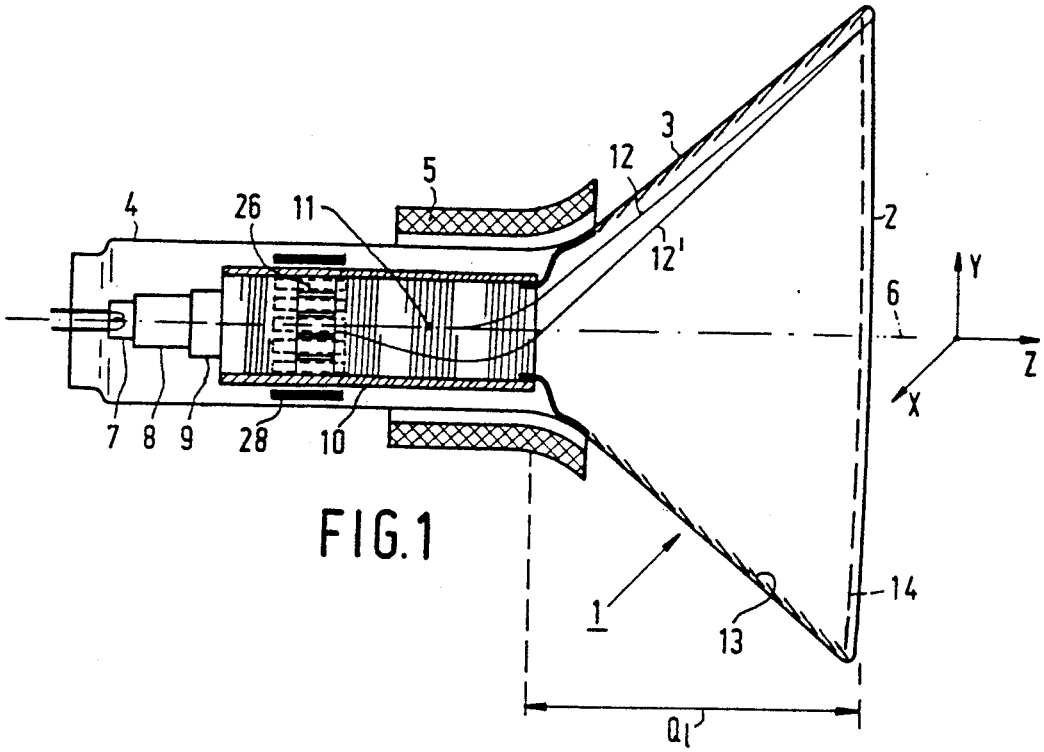
FIG. 1 is a diagrammatic cross-section of a picture display tube according to the invention, comprising an electron gun with a capacitively controllable correction element.

The device shown in FIG. 1 comprises a cathode ray tube having, inter alia a glass envelope 1 which is composed of a display window 2, a conical portion 3 and a neck 4. This neck accommodates a plurality of electrode structures 8, 9, which together with a cathode 7 constitute the beam-shaping part of an electron gun. The electron-optical axis 6 of the electron gun is also the axis of the envelope. An electron beam 12 is successively formed and accelerated by the cathode 7 and the electrode structures 8, 9. The reference numeral 10 denotes a tubular structure whose inner side is provided with a helical structure of a material having a very high electrical resistance and constituting a focusing lens 11 which focuses the beam on a display screen 14 on the inner side of the display window 2. Depending on the manner in which the voltages are supplied, the focusing lens may be e.g. of the uni-potential type, the bi-potential type or the tri-potential type. In the case of a bi-potential lens the voltages applied are, for example cathode 7: 50 V
electrode 8: 0 V
electrode 9: 500 V
entrance side of focusing lens 11: 7 kV
exit side of focusing lens 11: 30 kV.

The electron beam 12 is deflected from the axis 6 across the display screen 14 by means of a system 5 of deflection coils. Display screen 14 comprises a phosphor layer which is coated with a thin aluminium film which is electrically connected to the end of electrode 11 via a conducting coating 13 on the inner wall of the conical portion 3.

Figure 3:
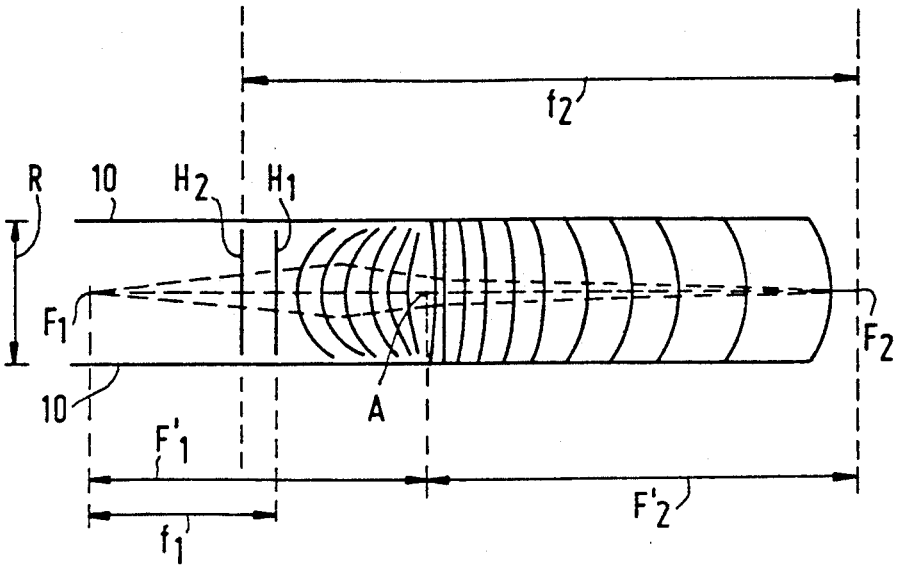
FIG. 3A shows a focusing field which can be generated by means of an electron gun of the type shown in FIG. 2.
FIG. 3B shows an interconnection means for use in an electron gun in accordance with the invention

FIG. 3A diagrammatically shows an example of a focusing lens field which can be generated by the focusing lens 11. The curved lines represent the lines of intersection of the equipotential planes which are produced by applying a voltage difference across the ends of the helical resistance structure, in the plane of the drawing. Each equipotential plane represents points having an equal refractive index. The centre of the lens is the point A. The focal lengths $f_1$ and $f_2$ are the distances between the focus $F_1$ and the first main surface $H_1$ and the distance between the focus $F_2$ and the second main surface $H_2$, respectively. The foci $F_1$ and $F_2$ are located at distances $F'_1$ and $F'_2$, respectively, from the centre A. A focusing lens generally has a portion with a converging effect followed by a portion with a diverging effect.

In FIG. 1 the focusing lens 11 is partly located in the field of the deflection coils because this is favourable for the resolving power of the display tube 1. However, the invention is not limited to such a mutual positioning.

The invention may be used to advantage in all picture display devices comprising cathode ray tubes using magnetic deflection, particularly in projection television display devices.

Figure 2A:
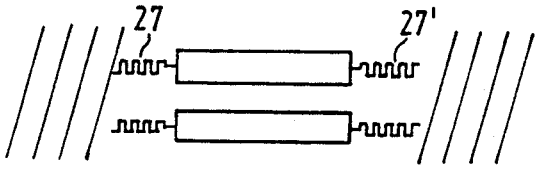
FIG. 2 is an elevational view of a longitudinal section of an electron gun suitable for use in the tube of FIG. 1.
Figure 2:
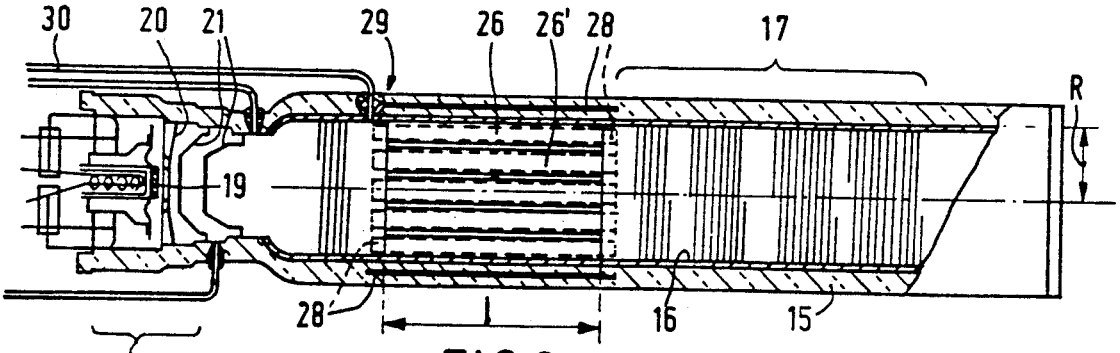

FIG. 2 shows in greater detail an electron gun of a type suitable for use in the display tube of FIG. 1. The type in question comprises a tubular (glass) envelope 15. A high-ohmic resistance layer 16 is provided on the inner side of the envelope 15, which layer is provided with a helical structure 17 near one end and which constitutes a focusing lens field when a suitable electric voltage is applied to the ends. The high-ohmic resistance layer 16 may be, for example glass enamel with a small amount (for example, several % by weight) of metal oxide (particularly ruthenium oxide) particles. The layer 16 may have a thickness of between 1 and 10 μm, for example 3 μm. The resistance per square of such a layer depends on the concentration of metal oxide and the firing treatment to which the layer is subjected. In practice resistances per square varying between $10^4$ and $10^8$ Q are realised. A desired resistance per square can be realised by adjusting the relevant parameters. A resistance per square of the order of $10^6$ to $10^7$ Q is very suitable for the present application. The total resistance of the helical structure formed in the layer 16 (which structure may be a continuous helix or a plurality of separate helixes connected by segments without a helical structure—4 in the embodiment of FIG. 2) may be of the order of 10 GQ, which means that a current of several microamperes will flow across the ends at a voltage difference of 30 kV.

The electron gun of FIG. 2 comprises a beam-shaping part 18 which generally comprises a cathode 19, a grid electrode 20 and anodes 21. The components of the beam-shaping part 18 may be mounted in the tubular envelope 15 of the focusing lens 1, as in the gun shown in FIG. 2. Alternatively, they may be mounted outside the tubular envelope of the focusing lens in the display tube, for example, by securing them to axial glass-ceramic mounting rods. The tubular envelope 15 may advantageously be constituted by the neck of the display tube. Such a display tube 22 is shown diagrammatically in FIG. 4. In this case a high-ohmic resistance layer with a helical structure 23 constituting a focusing lens is provided on a part of the inner side of the envelope 24 of the display tube 22.

Dynamic correction signals may have to be applied for different purposes. For example, in a projection TV system the red and blue tubes must be converged with respect to the green tube by means of so-called trapezium corrections. This has hitherto been done by means of magnetical corrections at both the line and field frequencies (sawtooth and parabola). For this purpose small convergence coils are used which are arranged at the cathode side of the deflection coil. The drawback of this system is that the power required to generate convergence currents is fairly high.

If the focusing section of an electron gun extends as far as the deflection section, it will be necessary to correct the electron beam dynamically by means of a dynamic quadripole so as to inhibit astigmatism and/or by means of a dynamic dipole for the purpose of opposed predeflection so as to compensate for coma. These corrections may be provided by means of a dynamically controlled magnetic multipole coil, but this has the same drawbacks as the convergence coils.

The invention relates to the possibility of providing these correction or convergence fields by means of electrodes which are formed in a different part of the high-ohmic resistance layer than that in which the focusing lens is formed. The high resistance of this layer (R = 10 MOhm per square) can be utilized for capacitively coupling in the dynamic correction signals with a metal electrode on the outer side of the glass envelope.

Figure 4:
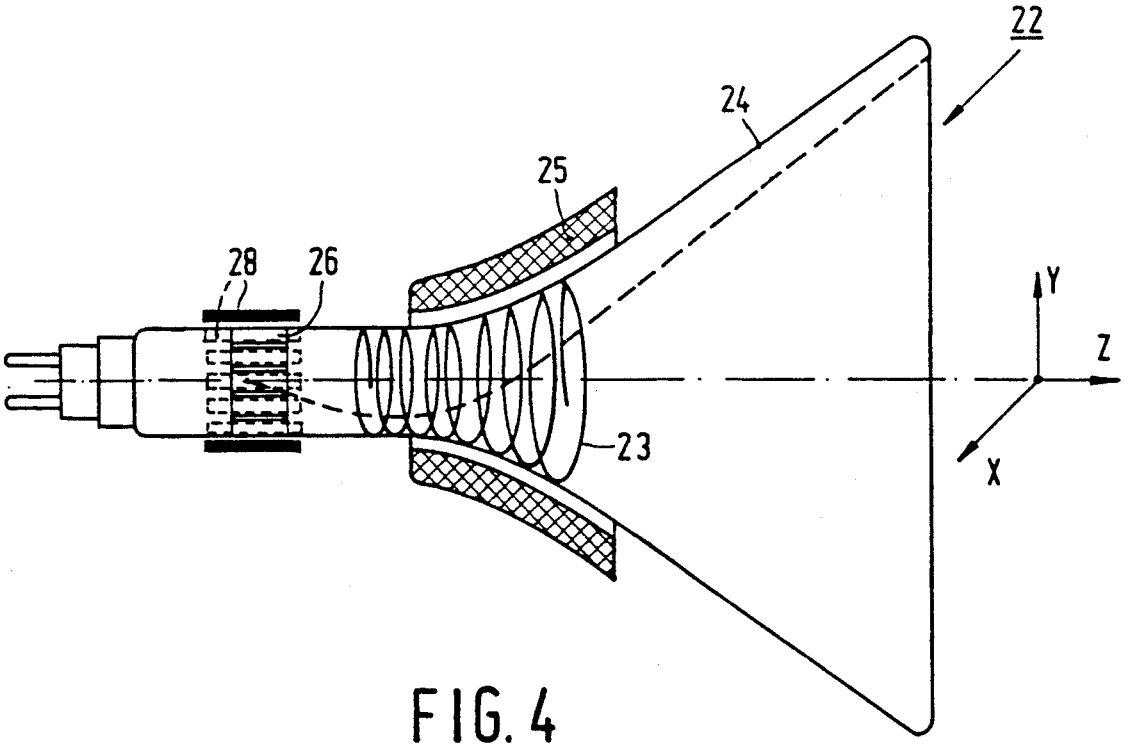
FIG. 4 shows an alternative embodiment of a picture display tube according to the invention in a cross-section.
Figure 5:
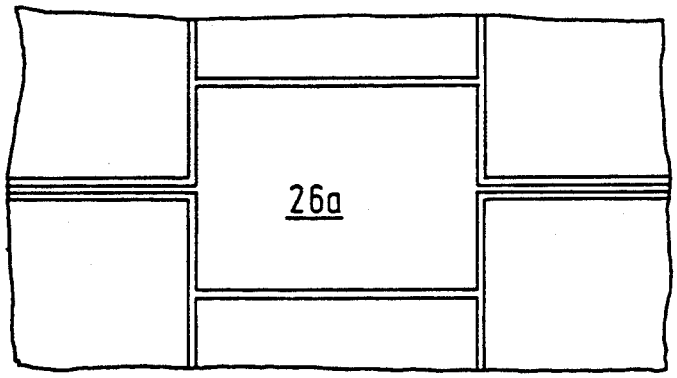
FIGS. 5, 6, 7 and 8 are diagrammatic embodiments of a part of the correction element of FIG. 1.
Figure 6:
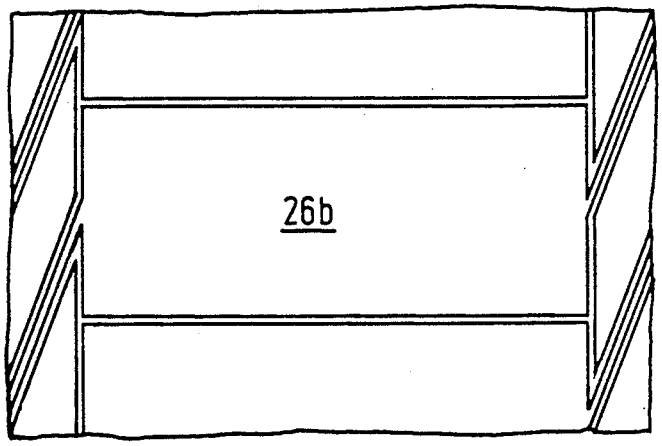
Figure 7:
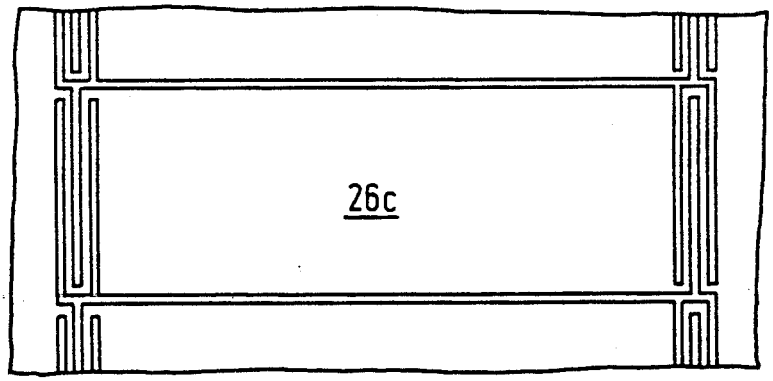
Figure 8:
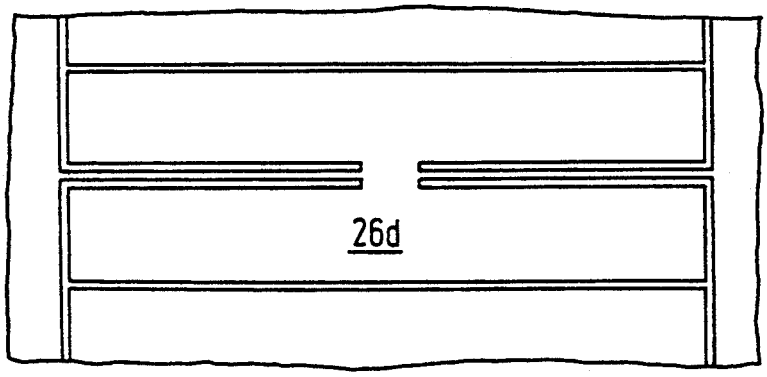

FIGS. 1, 2 and 4 show an octapole as an example of such correction electrodes, which octapole is arranged in the resistance layer between the prefocusing helix and the main lens in the form of a cylinder split up into eight (equal) axial segments 26, 26', etc. This octapole has a length l = 17 mm and a radius R = 5 mm. Each segment is preferably interconnected at the front and at the rear to the focusing electrode 17 by means of a meander 27, 27' etc. formed in the resistance layer (FIG. 3A). In the case of a resistance per square of 10 MOhm, the resistance of this connection can vary between 1 MOhm and 1 GOhm by adapting the shape of the meander. The capacitance of each octapole segment towards an electrode on the outer side of the glass envelope is $$C = \epsilon_r \epsilon_o \frac{2\pi R}{8} \frac{1}{6}$$

At a glass thickness d = 1 mm and $\epsilon_r = 5$ this results in a capacitance of 2.6 pF. This means that the RC time of this octapole may vary between 2.6 μs and 2.6 ms. When capacitively coupling in a dynamic correction signal with the metal outer electrode 28 the RC time must be large with respect to the line period which is currently 52 μs so that the resistance between octapole and focusing electrode must then be larger than 100 MOhm.

Time constants which are larger than the frame period of 10 ms will be difficult to realise. However, the field correction or field convergence signal may be coupled in by means of an ohmic contact because then the RC time to earth must be small. It is also possible to separate the field convergence from the line convergence and to continue coupling them in magnetically by means of convergence coils. The problem of power when generating convergence currents is in fact not so large for the field frequencies as for the line frequencies. For the correction signals which are required when integrating deflection and focusing, the need of field corrections, certainly at aspect ratios of 16:9, is much less than the need of line corrections.

In the above-described octapole a voltage of 100 V is sufficient to displace the beam on the screen of the tube by 1 mm. This displacement is proportional to this voltage, the magnification of the main lens and the length of the octapole and is inversely proportional to the radius of the octapole and the focusing voltage. Alternatively, the corrections can be provided by means of electrodes having a much more complicated shape than the simple octapole.

If the line frequency is further increased for future HDTV applications, the power problem in the case of magnetic convergence will only become greater. The above-described solution will be all the more attractive because the line period will continue to decrease in relation to the RC time of the convergence electrodes.

FIGS. 5, 6, 7 and 8 diagrammatically show components 26*a*, 26*b*, 26*c* and 26*d* of a correction element (for example, an octapole) which are provided with different types of high-ohmic connections for connection to the focusing electrode.

The principle of capacitively coupling in a dynamic correction signal will be described hereinafter.

The high-ohmic resistance layer 16 on the inner surface of the tubular structure 15 has parts in which a helical pattern is provided and parts without such a pattern so that an optimally static focusing field, particularly with respect to minimum spherical aberration, is obtained when applying a voltage. Dynamic correction signals are applied to electrodes 28 which comprise satisfactory electrically conducting material and coaxially surround a correction element 26 comprising a plurality of parts formed in the high-ohmic resistance layer and separated by an electrically non-conducting material. In this case the correction element is an octapole. The parts 26 of the correction elements are connected via high-ohmic connections, as are shown in FIGS. 5, 6, 7 and 8 to a normal static focusing voltage. A DC voltage acts on the correction element as a normal static focusing voltage. However, the correction element behaves in a different manner if the correction voltage on the electrodes 28 is modulated in time. The part of correction element 26 located under an electrode 28 on the inner wall of the tubular structure 25 will tend to follow the potential changes of the electrode 28. A correction element part and its associated electrode 28 may be considered to be a capacitor. When applying dynamic correction signals to the electrodes 28, these signals will be capacitively coupled in and passed on to the respective correction element parts which are connected at one end to the focusing signal supply lead and at the other end to the exterior via the resistors $R_1$ and $R_2$. Together with these resistors, each "capacitor" constitutes an RC network. Variations of the correction voltages $V_{dyn}$ which are (much) faster than the corresponding RC time cannot be attenuated and will be coupled in via the capacitor. The construction of FIG. 2 can be realised by providing metal (for example, aluminium) foil strips between two coaxial tubes which constitute the tubular structure 15 after softening and drawing on a mandril.

Alternatives for the above-described use of foil strips between two coaxial tubes are, for example vapour deposition or electroless deposition of a layer of satisfactory electrically conducting material on the outer surface of a tubular structure 24 in which the electrodes 28 are formed in the way shown in FIG. 4, or providing metal strips on such a tubular structure 24.

We claim:

1. A picture display device comprising a cathode ray tube including a display screen and an electron gun for producing at least one electron beam directed toward the screen along an electron optical axis, said tube being adapted for the attachment of deflection means for deflecting the electron beam across the screen, characterized in that the electron gun comprises:

a. a beam shaping part including a cathode for emitting electrons and electrode means for forming the electrons into said beam;

b. a tubular structure of insulating material surrounding the electron optical axis, said tubular structure including an inner surface on which is disposed at different axial positions a correction element and a helical focusing element, each of said elements being formed in a layer of resistive material having a high electrical resistance, said elements producing an electrical correction lens field and an electrical focusing lens field, respectively, when respective voltages are applied to said elements;

c. a surface electrode disposed on an outer surface of the tubular structure and extending over at least a portion of the correction element, said surface electrode, said portion of the correction element and the insulating material of the tubular structure which is disposed between said surface electrode and said portion forming a capacitor;

d. first voltage supplying means for applying a static voltage to the helical focusing element to effect focusing of the electron beam; and e. second voltage supplying means for applying a dynamically variable correction voltage to the surface electrode, said voltage being coupled through said capacitor to the correction element to effect dynamic correction of the electron beam.

2. A device as claimed in claim 1, characterized in that the correction element is formed for generating a dipole field which predeflects the electron beam synchronously with and in a direction opposite to the direction in which the beam is deflected by the deflection means.

3. A device as claimed in claim 1, characterized in that the correction element is formed for generating a 2N pole field (N=2 or 4).

4. A device as claimed in claim 1, characterized in that the correction element is formed for generating a field which gives the frame on the display screen a trapezoidal shape.

5. A device as in claim 1 where the correction element and the helical focusing element are formed in a common layer of resistive material.

* * * * *